United States Patent [19]

Campbell

[11] 4,030,103

[45] June 14, 1977

[54] DEPLOYABLE OFFSET PARABOLOID ANTENNA

[75] Inventor: Gordon Kieth Colin Campbell, Los Altos, Calif.

[73] Assignee: Lockheed Missiles & Space Company, Inc., Sunnyvale, Calif.

[22] Filed: Dec. 10, 1975

[21] Appl. No.: 639,236

[52] U.S. Cl. ..... 343/915; 343/834; 343/897

[51] Int. Cl.[2] ..... H01Q 15/20

[58] Field of Search ..... 343/840, 915, 775, 897, 343/834, 839

[56] References Cited

UNITED STATES PATENTS

| | | | |
|---|---|---|---|
| 2,540,518 | 2/1951 | Gluyas | 343/840 |
| 2,763,002 | 9/1956 | Fitzgerald et al. | 343/915 |
| 3,360,798 | 12/1967 | Webb | 343/915 |
| 3,521,290 | 7/1970 | Bahiman et al. | 343/915 |
| 3,541,569 | 11/1970 | Berks | 343/915 |
| 3,707,720 | 12/1972 | Staehlin | 343/840 |
| 3,715,760 | 2/1973 | Palmer | 343/915 |

*Primary Examiner*—Harold A. Dixon
*Attorney, Agent, or Firm*—H. Donald Volk; Billy G. Corber

[57] ABSTRACT

This invention relates to a deployable antenna or reflector having an offset paraboloid shape. The antenna can be packaged in a small volume. Radial ribs, interconnected by stiffeners, extend from a semicircular support hub. A metalized mesh is stretched between the radial ribs to form a reflective surface.

2 Claims, 4 Drawing Figures

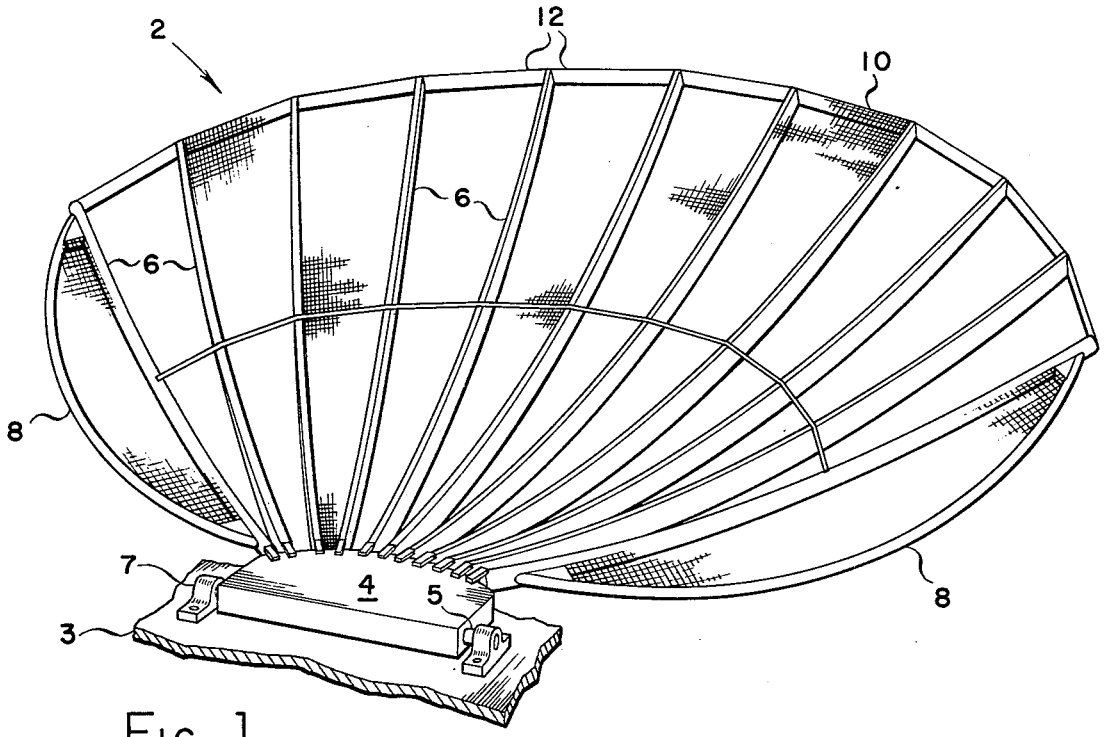
FIG. 1
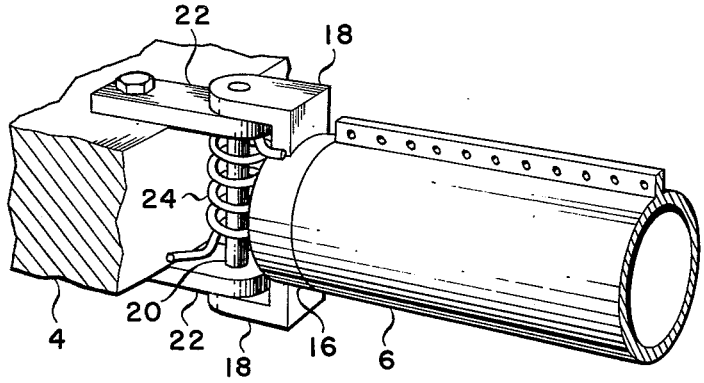
FIG. 3
FIG. 4
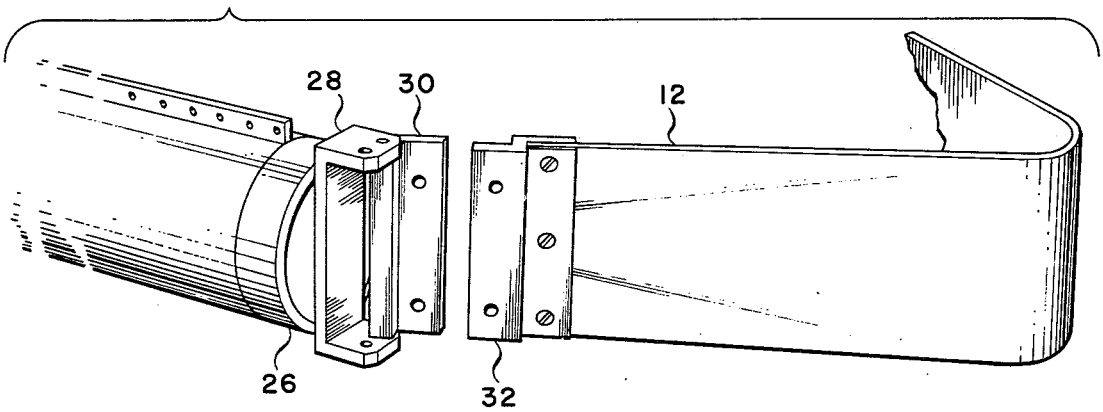

DEPLOYABLE OFFSET PARABOLOID ANTENNA

BACKGROUND OF THE INVENTION

This invention relates generally to offset paraboloid shaped structures to be used as antenna reflectors or the like. More particularly, the invention relates to a foldable offset paraboloid structure which is deployable to a rigid offset paraboloid configuration.

Heretofore, it has been known that there are many and various types of collapsible antennae which may be deployed from a small package configuration to a larger reflective configuration.

Numerous techniques have been utilized in the prior art to form deployable antennae. One example contemplates the use of a number of ribs which are unfolded in a manner of an umbrella and to which is attached a flexible metalized membrane. Another proposed device utilizes rib-like members that are wound or furled about a central hub and which when unfurled extend radially to support a metalized flexible reflecting surface. Other examples of deployable arrangements are described in U.S. Pat. Nos. 3,503,072; 3,605,107; 3,618,111; 3,631,505; 3,707,720; 3,780,375. These systems all show that the final deployed structure should be dish-shaped.

In contrast, the deployable antenna system of the invention provides an offset paraboloid antenna which greatly simplifies storage of the antenna prior to deployment and allows a number of antennae in the space heretofore required to house a single antenna.

SUMMARY OF THE INVENTION

In accordance with the present invention, a preferred embodiment includes a lightweight flexible electrically conductive mesh such as dacron woven cloth plated with copper and silicone. The mesh is supported by a series of radial ribs and a rigid semicircle means on the sides. The preformed contour of the mesh is an offset paraboloid, and it is held in this offset paraboloid shape by attachment to the preformed parabolic shape of the radial ribs. The outer perimeter of the radial ribs is connected by resilient peripheral stiffeners. On extension of the total rigid structure, the mesh is held in a tensioned manner. A semicircular support hub supports an antenna. The radial ribs are pivotally attached to the hub.

BRIEF DESCRIPTION OF THE DRAWINGS

Further features and advantages of the invention pertain to the particular arrangment and strucure whereby the above-mentioned aspects of the invention are attained. The invention will be better understood by reference to the following description and to the drawings forming a part thereof, wherein:

FIG. 1 is a perspective view of an embodiment of the offset paraboloid antenna in the deployed position.

FIG. 3 is an enlarged fragmentary view of the hinged relation of the radial beams and the hub.

FIG. 4 is an enlarged fragmentary view of the embodiment of FIG. 1 showing relation of the resilient peripheral stiffeners and the radial ribs.

DESCRIPTION OF THE PREFERRED EMBODIMENT

Figure 2:
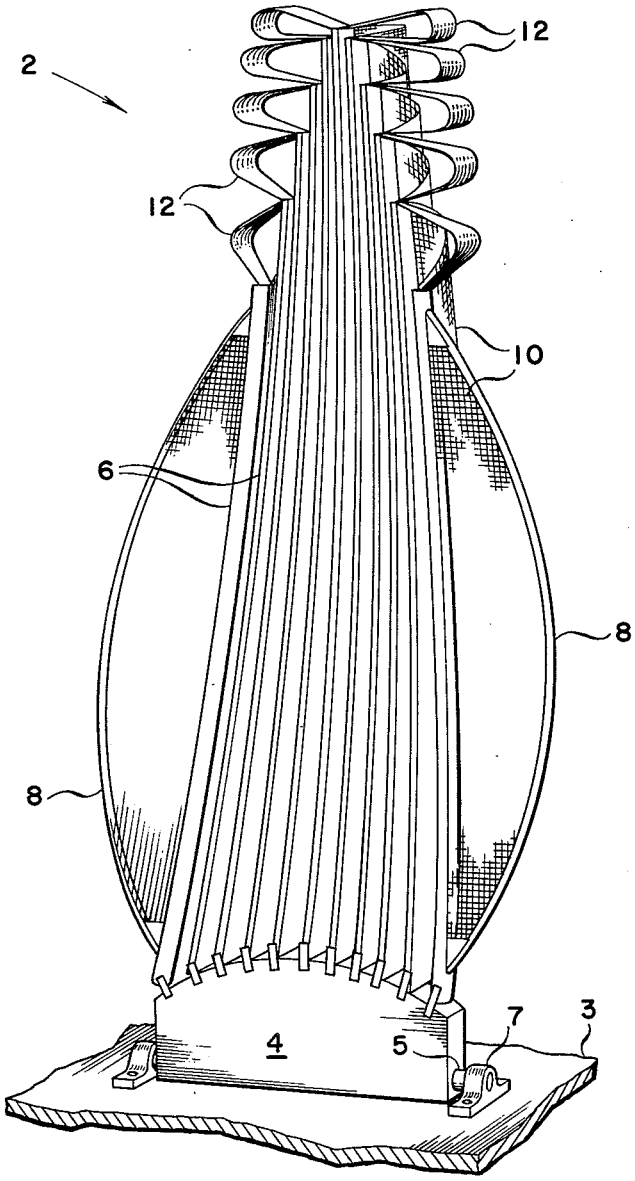
FIG. 2 is a perspective view of an embodiment of the offset paraboloid antenna in the stowed condition.

A deployable offset paraboloid antenna i.e., an antenna with a paraboloid shape which is fed from a feed in a position offset from the focal point, of the present invention is generally indicated at 2 in FIGS. 1 and 2. As shown more particularly in the completely deployable position of FIG. 1, the antenna 2 includes semicircular hub 4, a plurality of radial ribs 6 spaced about and pivotably attached to the hub 4, and a pair of rigid semicircular side supports 8 attached to the outer radial ribs 6. The radial ribs 6 and the rigid side supports 8 form an offset paraboloid. A lightweight metalized mesh 10 is stretched across the radial ribs 6 to form the offset paraboloid reflective surface. A series of foldable resilient stiffeners 12 ring the outer periphery of the offset paraboloid reflector to hold the radial ribs in their proper position. A rigid feed horn (not shown) is mounted to the base 3.

Hub 4 includes a mounting shaft 5. Mounting shaft 5 is rotatably mounted on pillow block 7 on base 3. A tension spring (not shown) is mounted to the base 3 and the hub 4 for pivoting the hub relative to the base when the antenna is deployed. Dampers (not shown) are also mounted to the base and the hub for limiting the deployment rate.

Referring now to FIG. 3, the hub end of each of the radial ribs 6 terminates in a circular end cap 16. The circular end cap 16 includes a pair of protruding mounting ears 18 that include holes for receiving a hinge pin 20. A plurality of pairs of mounting brackets 22 support the hinge pins 20 on the hub 4.

A coil shaped deployment spring 24 is mounted on hinge pin 20 for urging radial ribs 6 to the deployed position.

Referring now to FIG. 4, the outboard end of each of the radial ribs 6 terminates in a second circular end cap 26. A U-shaped hinge-pin support bracket 28 is mounted on end cap 26 and is adapted for receiving two hinges 30. A foldable resilient stiffener 12 is attached to each of the hinges 30 via support bracket 32 to assist the deployment springs to deploy the antenna and for retaining the antenna in the deployed position.

In operation, the antenna is folded as shown in FIG. 2 and pivoted relative to base 3 and held in that position by conventional restraining means (not shown). To deploy the antenna, the restraining means is released. This allows the tensioning spring to pivot the antenna on mounting shaft 5 until it is in the position shown in FIG. 1. Dampers (not shown) limit the speed of the pivoting of the antenna.

The release of the restraining means also leaves the antenna free to unfold. Springs 24, in combination with the folded resilient stiffeners 12, spring the antenna into its deployed rigid shape, thus tensioning the metalized mesh into its preformed offset paraboloid shape.

It may be seen that there has been described herein an improved deployable antenna having numerous advantages in both its structure and operation. The structure described herein is presently considered to be preferred; however, it is contemplated that further variations and modifications within the purview of those skilled in the art can be made herein. The following claims are intended to cover all such variations and modifications as fall within the true spirit and scope of the invention.

What is claimed:

1. An antenna with a paraboloid shape which is fed from a feed in a position offset from the focal point of the paraboloid, said antenna deployable from a retractable stowed position to an extended deployed position, comprising:

a rigid generally semicircular support hub, a number of radial ribs spaced about said support hub, each of said radial ribs including inner and outer ends, a pair of rigid semicircular side supports attached to each of the outer radial ribs, said radial ribs and said semicircular side supports defining an offset paraboloid when deployed, inner hinge means pivotally joining the inner ends of said radial ribs to said support hub, outer hinge means pivotally connected to the outer ends of each of said radial ribs, foldable stiffeners connected to the outer hinge means of adjacent radial ribs for maintaining the adjacent ribs in a spaced apart relationship when the antenna is deployed, and a preformed lightweight flexible metalized mesh stretched across and attached to said radial ribs and said semicircular side supports for forming a paraboloid shaped reflective surface when said antenna is deployed.

2. The deployable antenna of claim 1 wherein said inner hinge means includes a mounting bracket attached to said support hub, an end cap rigidly affixed to each of said radial ribs and a resilient means cooperating with said support hub and said end cap for urging said radial ribs into the deployed position.

* * * * *